US005393052A

United States Patent [19]

Kennedy

[11] Patent Number: 5,393,052

[45] Date of Patent: Feb. 28, 1995

[54] GOLFING DEVICE FOR DIVOT REPAIR/CLUB HOLDING/BALL MARK RETENTION

[76] Inventor: Todd E. Kennedy, 5495 S. Stonegate, Springfield, Mo. 65810

[21] Appl. No.: 181,813

[22] Filed: Jan. 18, 1994

[51] Int. Cl.[6] ..... A63B 57/00

[52] U.S. Cl. ..... 273/32 B; 248/530; 172/380; 273/32 A

[58] Field of Search ..... 273/32 A, 32 B; 172/378, 379, 380; 248/530, 156

[56] References Cited

U.S. PATENT DOCUMENTS

| | | | |
|---|---|---|---|
| 3,339,300 | 9/1967 | Bury | 273/32 A |
| 5,121,519 | 6/1992 | Haugom | 273/32 A X |
| 5,226,647 | 7/1993 | Notarmuzi | 273/32 B |

*Primary Examiner*—George J. Marlo

[57] ABSTRACT

A golfing device for divot repair/club holding/ball mark retention. The device has a central body portion with a narrow first end and a wide second end. A pair of long legs extend from the first end of the main body portion with a long u-shaped recess therebetween. The long legs have free ends remote from the first ends adapted to function as divot repair. A pair of short legs extend from the second end of the main body portion and have a shallow c-shaped recess between the legs. The short legs have a c-shaped recess adapted to hold the end of a golf club when the long legs are inserted into the ground. Lateral edges of the long legs, main body portion and short legs form smooth continuous lines in a tapering configuration being widest at the free ends of the short legs and being narrowest at the free ends of the long legs. A flat planar supplemental recess is formed in the c-shaped recess to receive the periphery of a ball mark for positioning therein and separation therefrom in marking a spot on a putting green from which a ball is lifted.

1 Claim, 2 Drawing Sheets

GOLFING DEVICE FOR DIVOT REPAIR/CLUB HOLDING/BALL MARK RETENTION

BACKGROUND OF THE INVENTION

1. Field of the Invention

The present invention relates to a new and improved golfing device for divot repair/club holding/ball mark retention and more particularly pertains to repairing divots, holding the end of a golf club and retaining a ball mark.

2. Description of the Prior Art

The use of devices for repairing divots, devices for holding a golf club and devices for retaining a ball mark is known in the prior art. More specifically, devices for repairing divots, devices for holding a golf club and devices for retaining a ball mark heretofore devised and utilized for the purpose of repairing divots on greens, holding the end of a golf club and retaining a ball mark are known to consist basically of familiar, expected, and obvious structural configurations, notwithstanding the myriad of designs encompassed by the crowded prior art which has been developed for the fulfillment of countless objectives and requirements.

The prior art discloses a large number of devices for repairing divots, devices for holding a golf club and devices for retaining a ball mark. By way of example, Borden U.S. Pat. No. 5,054,777 discloses a golf accessory.

Larson U.S. Pat. No. 5,110,123 discloses a combined divot repairer and ball marker/spotter.

McDonald U.S. Pat. No. 5,160,134 discloses a combined golf green repair tool and timepiece.

Jackson U.S. Pat. No. Des. 247,790 discloses a combined golf ball marker and divot replacement tool.

Lastly, Cellura U.S. Pat. No. Des. 331,090 discloses a combined golf green repair tool and holder for ball marker.

In this respect, a new and improved golfing device for divot repair/club holding/ball mark retention according to the present invention substantially departs from the conventional concepts and designs of the prior art, and in doing so provides an apparatus primarily developed for the purpose of repairing divots, holding the end of a golf club and retaining a ball mark.

Therefore, it can be appreciated that there exists a continuing need for a new and improved golfing device for divot repair/club holding/ball mark retention which can be used for repairing divots, holding the end of a golf club and retaining a ball mark. In this regard, the present invention substantially fulfills this need.

SUMMARY OF THE INVENTION

In view of the foregoing disadvantages inherent in the known types of devices for repairing divots, devices for holding a golf club and devices for retaining a ball mark now present in the prior art, the present invention provides a new and improved golfing device for divot repair/club holding/ball mark retention. As such, the general purpose of the present invention, which will be described subsequently in greater detail, is to provide a new and improved golfing device for divot repair/club holding/ball mark retention and methods which have all the advantages of the prior art and none of the disadvantages.

To attain this, the present invention essentially comprises a new and improved golfing device for divot repair/club holding/ball mark retention comprising, in combination, a central body portion, the central body portion having lateral edges and a narrow first end and a wide second end opposite from the first end; a pair of long legs extending from the narrow first end of the main body portion with a long u-shaped recess therein, the ends of the long legs having lateral edges with free ends remote from the first ends adapted to function as divot repair when held by a user at the main body portion; a pair of short legs extending from the second end of the main body portion, the short legs having a shallow c-shaped recess between the legs, the short legs having lateral edges, the c-shaped recess adapted to hold the end of a golf club when the long legs are inserted into the ground, the lateral edges of the long legs, main body portion and short legs forming smooth continuous lines in a tapering configuration being widest at the free ends of the short legs and being narrowest at the free ends of the long legs; and a flat planar supplemental recess formed in the c-shaped recess extending from the free ends of the short legs in a continuous curve through the entire c-shaped recess, the supplemental recess adapted to receive the periphery of a ball mark for positioning therein and separation therefrom in marking a spot on a putting green from which a ball is lifted.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golfing device for divot repair/club holding/ball mark retention which has all the advantages of the prior art devices for repairing divots, devices for holding a golf club and devices for retaining a ball mark and none of the disadvantages.

It is another object of the present invention to provide a new and improved golfing device for divot repair/club holding/ball mark retention which may be easily and efficiently manufactured and marketed.

It is a further object of the present invention to provide a new and improved golfing device for divot repair/club holding/ball mark retention which is of a durable and reliable construction.

An even further object of the present invention is to provide a new and improved golfing device for divot repair/club holding/ball mark retention which is susceptible of a low cost of manufacture with regard to both materials and labor, and which accordingly is then susceptible of low prices of sale to the consuming public, thereby making such a new and improved golfing device for divot repair/club holding/ball mark retention economically available to the buying public.

Still yet another object of the present invention is to provide a new and improved golfing device for divot repair/club holding/ball mark retention which provides in the apparatuses and methods of the prior art some of the advantages thereof, while simultaneously overcoming some of the disadvantages normally associated therewith.

Even still another object of the present invention is to repair divots, hold the end of a golf club and retain a ball mark.

Lastly, it is an object of the present invention to provide a golfing device for divot repair/club holding/ball mark retention comprising a central body portion, the central body portion having lateral edges and a narrow first end and a wide second end opposite from the first end; a pair of long legs extending from the narrow first end of the main body portion with a long u-shaped recess therein, the ends of the long legs having lateral edges with free ends remote from the first ends adapted to function as divot repair; and a pair of short legs extending from the second end of the main body portion, the short legs having a shallow c-shaped recess between the legs, the short legs having lateral edges.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
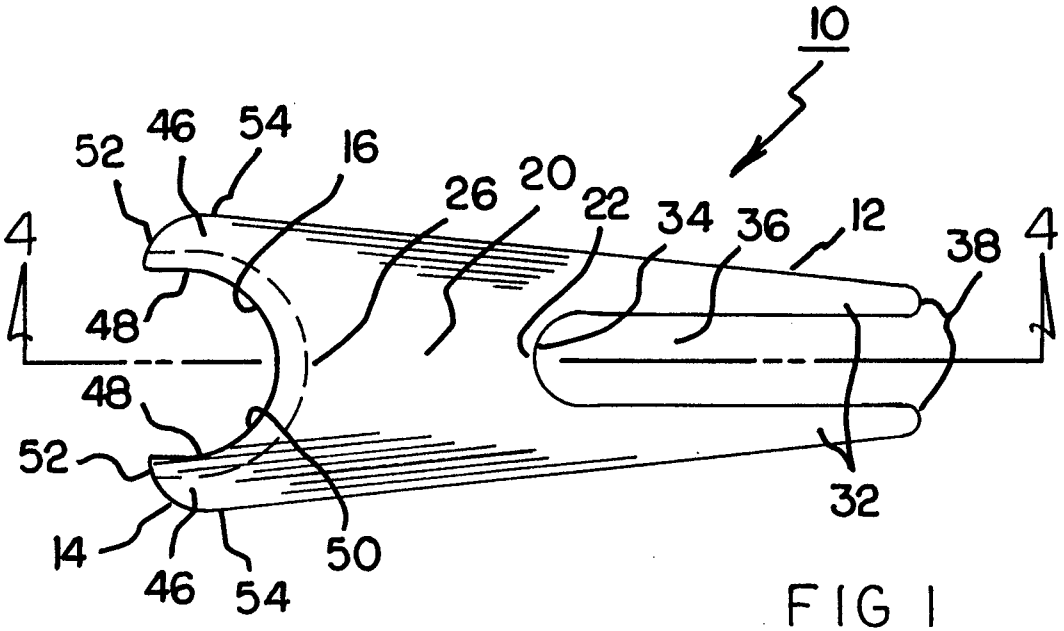
FIG. 1 is the preferred embodiment of the new and improve a new and improved golfing device for divot repair/club holding/ball mark retention constructed in accordance with the principles of the present invention.
Figure 2:
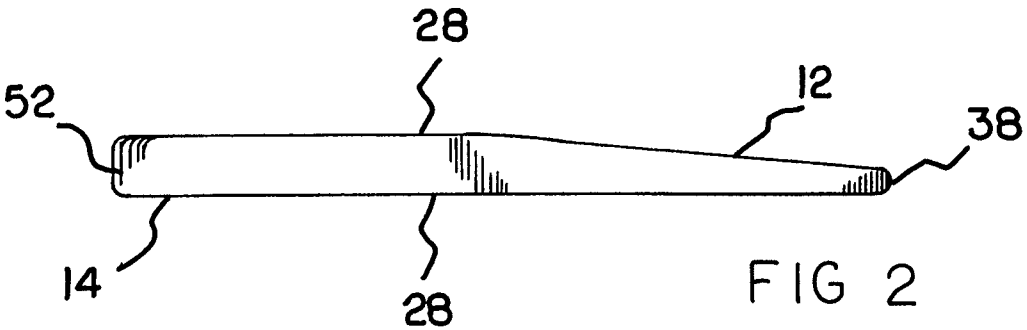
FIG. 2 is a side elevational view of the device shown in FIG. 1.
Figure 3:
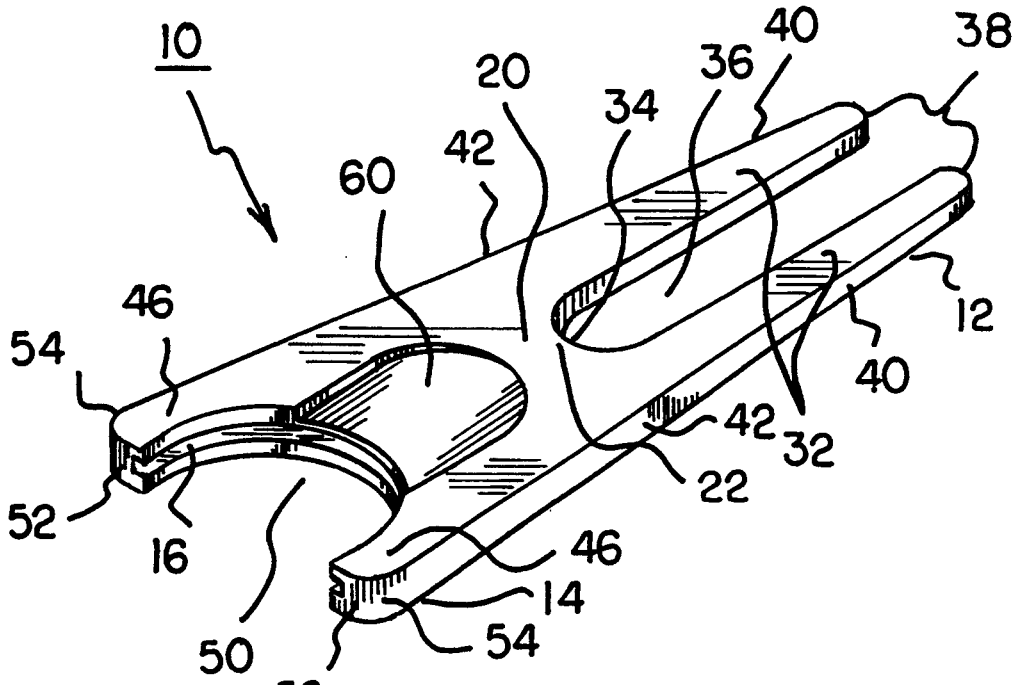
FIG. 3 is a perspective illustration of the device of the prior Figures shown from the opposite side thereof.
Figure 4:
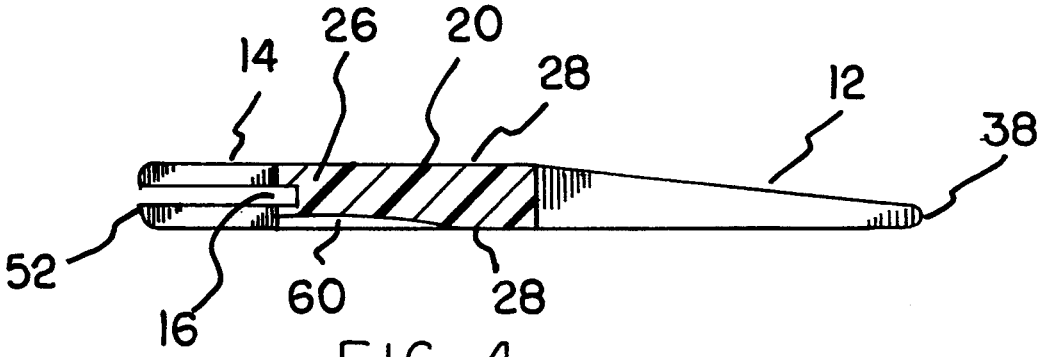
FIG. 4 is a cross-sectional view taken along line 4—4 of FIG. 1.

With reference now to the drawings, and in particular to FIGS. 1 through 4 thereof, the preferred embodiment of the new and improved golfing device for divot repair/club holding/ball mark retention embodying the principles and concepts of the present invention and generally designated by the reference numeral 10 will be described.

Specifically, the present invention, the new and improved golfing device for divot repair/club holding/ball mark retention, is a combination device 10 provided with a divot repair component 12, a golf club holding component 14, and a ball mark holding recess 16. The various components are fabricated individually and with respect with each other in order to achieve the intended objectives.

More specifically, the combination device 10 includes a main body portion 20. The main body portion has lateral edges 42. It also has a relatively narrow first edge 22 as well as a wide second edge 26. The main body portion thus provides opposed parallel faces 28 for being held by the golfer when utilizing the device 10 for any of its plurality of intended functions.

Extending outboardly from the first or narrow edge 22 of the main body portion 20 are a pair of long legs 32. The long legs 32 have interior parallel edges in a linear fashion with a lowermost curved end 34 adjacent to the first edge 24. The parallel edges form a u-shaped recess 36. The legs also have outboard ends 38 most remote from the first edge 24 of the main body portion 20. The legs also have lateral edges 40 which are formed as extensions of the lateral edges 42 of the main body portion 20.

The long legs 32 act as prongs to be inserted into the surface of a green with a divot mark between. When so inserted, the user can hold the main body portion 20 and pivot the long legs upwardly for the purpose of repairing the divot. This is done in a conventional manner.

The next component of the combination device 10 are a pair of short parallel legs 46. The parallel legs have interior edges 48 which are curved to form a c-shaped recess 50. The short legs have free ends 52 at their ends most remote from the second edge 26 of the main body portion 20. Also included as part of the short legs are their lateral edges 54. These lateral edges 54 are formed as extensions of the lateral edges 42 of the main body portion 20. The lateral edges of the long legs, main body portion, and short legs form smooth lines tapering from one end of the device to the other. The widest extent is adjacent to the free ends 52 of the short legs 46. The narrowest extent of the taper is at the free ends 38 of the long legs 32.

The short legs 46 function as the club holder 14 in that the main body portion 20 may be grasped by the player with the long legs 32 inserted into the ground and with the body portion 20 thereabove and with the short legs 46 extending upwardly. The c-shaped recess 50 thus forms a surface above the ground and grass top whereby a player may rest his club with one end on the ground and with the upper shaft portion of the club resting on the c-shaped recess 50. In this manner, the materials of the club grip will not become wet or soiled which might otherwise occur if the grip were placed on the ground. One face of the device 10 tapers from the main body portion 20 to the free end 38 of the long legs to render it easier for insertion into the ground.

The last component of the device is the mark retainer. The mark retainer is formed as a supplemental recess 16. Such recess 16 in a flat planar configuration formed as an indentation within the c-shaped recess 50. The supplemental recess has an end at one end 52 of a short leg 46. Such supplemental recess then continues in a curved manner downwardly around a section of the recess closest to the second edge 26 and continues to the opposite free end 52 of the opposite short leg 46. A fingertip-shaped indentation 60 is formed in the face of the main body portion opposite from the taper to assist in locating and grasping the main body portion for these various functions.

The supplemental recess 16 is of such size, depth and thickness so as to support at least fifty percent of the periphery of a ball mark. The ball mark may take the form of a coin, as for example a dime. In the alternative, the ball mark could be a plastic disk-shaped member with a prong extending centrally from one face for insertion into the ground. This is to insure that when placed on the ground it will not move laterally if struck by another ball rolling thereover. The use of ball marks is conventional in the play of golf. It is used by holding the main body portion 20 in one hand of the golfer and the ball mark in the other. In this manner, the ball mark may be inserted into the supplemental recess for storage in a golfer's pocket of his trousers or the pocket of a golf bag. When so holding the main body portion 20 and marker, the marker may be removed by applying a force to separate the mark from the supplemental recess which is normally holding the periphery of the mark by the forces of gravity.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A golfing device for divot repair/club holding/ball mark retention comprising, in combination:

a central body portion, the central body portion having lateral edges and a narrow first end and a wide second end opposite from the first end;

a pair of long legs constituting about half the length of the device and extending from the narrow first end of the main body portion with a long u-shaped recess therebetween, the ends of the long legs having lateral edges with free ends remote from the first end adapted to function as divot repair when held by a user at the main body portion;

a pair of short legs extending from the second end of the main body portion, the short legs having a shallow c-shaped recess between the legs, the short legs having lateral edges, the c-shaped recess adapted to hold the end of a golf club when the long legs are inserted into the ground, the lateral edges of the long legs, main body portion and short legs forming smooth continuous lines in a symmetric tapering configuration being widest at the free ends of the short legs and being narrowest at the free ends of the long legs; and a flat planar supplemental recess formed in the c-shaped recess extending from the free ends of the short legs in a continuous curve through the entire c-shaped recess, the supplemental recess adapted to receive the periphery of a ball mark for positioning therein and separation therefrom in marking a spot on a putting green from which a ball is lifted.

* * * * *